US009103357B2

(12) United States Patent
Yang et al.

(10) Patent No.: US 9,103,357 B2
(45) Date of Patent: Aug. 11, 2015

(54) CYLINDER

(71) Applicant: SHENZHEN CHINA STAR OPTOELECTRONICS TECHNOLOGY CO., LTD, Shenzhen (CN)

(72) Inventors: Weibing Yang, Shenzhen (CN); Chunhao Wu, Shenzhen (CN); Kunhsien Lin, Shenzhen (CN); Yongqiang Wang, Shenzhen (CN); Zhiyou Shu, Shenzhen (CN); Minghu Qi, Shenzhen (CN); Zenghong Chen, Shenzhen (CN); Zhenhua Guo, Shenzhen (CN)

( * ) Notice: Subject to any disclaimer, the term of this patent is extended or adjusted under 35 U.S.C. 154(b) by 393 days.

(21) Appl. No.: 13/698,282

(22) PCT Filed: Oct. 23, 2012

(86) PCT No.: PCT/CN2012/083349
§ 371 (c)(1),
(2) Date: Nov. 16, 2012

(87) PCT Pub. No.: WO2014/047993
PCT Pub. Date: Apr. 3, 2014

(65) Prior Publication Data

US 2014/0090555 A1 Apr. 3, 2014

(30) Foreign Application Priority Data

Sep. 29, 2012 (CN) ..... 2012 1 0374691

(51) Int. Cl.
*F15B 15/22* (2006.01)

(52) U.S. Cl.
CPC ..... *F15B 15/226* (2013.01); *F15B 15/223* (2013.01); *F15B 2211/8855* (2013.01)

(58) Field of Classification Search
CPC ..... F15B 15/223; F15B 15/226; F01B 11/04
USPC ..... 91/404, 405
See application file for complete search history.

(56) References Cited

U.S. PATENT DOCUMENTS 2,833,312 A 5/1958 Flick
3,247,767 A * 4/1966 Aslan ..... 91/26

(Continued)

FOREIGN PATENT DOCUMENTS

CN 1199147 A 11/1998
CN 1896552 A 1/2007
CN 201062601 Y 5/2008
CN 201636117 U 11/2010
CN 102235395 A 11/2011

(Continued)

OTHER PUBLICATIONS

Chen Zhihong, the International Searching Authority written comments, Jul. 2013, CN.

*Primary Examiner* — Thomas E Lazo

(57) ABSTRACT

A cylinder comprises a cylinder body, a main cavity body, a piston and a piston rod. Air inlets and air outlets are arranged in each of two opposite ends of the cylinder body. The cylinder is further configured with an anti-collision structure. The anti-collision structure comprises a buffer rod arranged on the piston. The cylinder body defines a receiving hole corresponding to the buffer rod. The receiving hole is configured with a first sealing ring that seals a gap between the buffer rod and the receiving hole. The anti-collision structure has a flexible buffering function and does not generate hard impact. Thus, the cylinder has a low vibration and high stability.

9 Claims, 3 Drawing Sheets

(56) References Cited

U.S. PATENT DOCUMENTS

| | | | | |
|---|---|---|---|---|
| 3,267,815 | A * | 8/1966 | Ortman et al. | 91/26 |
| 3,805,672 | A * | 4/1974 | Pekrul | 91/396 |
| 4,088,061 | A * | 5/1978 | Stoll et al. | 91/26 |
| 4,651,623 | A | 3/1987 | Rogers | |
| 5,943,939 | A * | 8/1999 | Orihara | 91/407 |
| 6,173,938 | B1 | 1/2001 | McAndrew | |
| 6,481,331 | B1 * | 11/2002 | Guo | 91/395 |
| 6,536,327 | B2 * | 3/2003 | Zona | 91/394 |

FOREIGN PATENT DOCUMENTS

| | | | |
|---|---|---|---|
| CN | 102345652 | A | 2/2012 |
| CN | 102705299 | A | 10/2012 |
| CN | 202628674 | U | 12/2012 |
| DE | 3441005 | A1 | 5/1985 |
| DE | 4401871 | A1 | 7/1995 |
| JP | H10184608 | A | 7/1998 |
| JP | 2000130408 | A | 5/2000 |
| JP | 2001137268 | A | 5/2001 |

* cited by examiner

CYLINDER

TECHNICAL FIELD

The present disclosure relates to the field of pneumatic transmission, and more particularly to a cylinder.

BACKGROUND

In the prior art, a cylinder uses a high-pressure gas or a high-pressure liquid as a power source to reciprocate motion for a transmission function. As shown in FIG. 1, the cylinder generally includes a cylinder body 1, a main cavity body 2, a piston 3, and a piston rod 4. The cylinder body 1 defines an air inlet and an air outlet 5 in each of two opposite ends of the cylinder. In a working process of the cylinder, the piston impacts a front cover and a back cover of the cylinder body causing the piston to stop. A stopped process of the piston impacting the cylinder causes great mechanical damage to the cylinder, and greatly increases abrasion and deformation, resulting in reduction of life of the cylinder. In addition, vibration is generated by the impact. When the cylinder transmitted workpieces, the workpieces sensitive to the vibration may be adversely affected and application range is limited.

SUMMARY

In view of the above-described problems, the aim of the present disclosure is to provide an impact-free cylinder having a buffering function.

The technical scheme of the present disclosure is that: A cylinder comprises a cylinder body, a main cavity body, a piston and a piston rod. The cylinder body defines an air inlet and an air outlet in each of two opposite ends of the cylinder body. The cylinder is further configured with an anti-collision structure. The anti-collision structure comprises a buffer rod arranged on the piston. The cylinder body defines a receiving hole corresponding to the buffer rod. The receiving hole is configured with a first sealing ring that further seals a gap between the buffer rod and the receiving hole. The cylinder further comprises a buffer speed regulating structure. The buffer speed regulating structure comprises a branch gas flow channel that connects to the main cavity body and the receiving hole, and a speed regulator. The speed regulator is arranged on the branch gas flow channel, and is a regulating screw. The cylinder body defines a regulating screw installing hole. One opening in the branch gas flow channel is positioned in a middle region of the receiving hole. The receiving hole is configured with a second sealing ring that further seals the gap between the buffer rod and the receiving hole. The second sealing ring is positioned at the opening of the branch gas flow channel in the receiving hole. When entering the receiving hole and cooperating with the second sealing ring, the buffer rod obstructs gas in the main cavity body from flowing out of the branch gas flow channel. The cross-section of the second sealing ring is trapeziform in shape. The air inlet and the air outlet is arranged on a tail end of the receiving hole. An axis of the buffer rod coincides with an axis of the piston. Diameter of the buffer rod is larger than diameter of the piston rod.

Another technical scheme of the present disclosure is that: A cylinder comprises a cylinder body, a main cavity body, a piston and a piston rod. The cylinder body defines an air inlet, and an air outlet in each of two opposite ends of the cylinder body. The cylinder is further configured with an anti-collision structure. The anticollision structure comprises a buffer rod arranged on the piston. The cylinder body defines a receiving hole corresponding to the buffer rod. The receiving hole is configured with a first sealing ring that further seals a gap between the buffer rod and the receiving hole.

In one example, the cylinder further comprises a buffer speed regulating, structure. The buffer speed regulating structure comprises a branch gas flow channel that connects to the main cavity body and the receiving hole, and a speed regulator. The speed regulator is arranged on the branch gas flow channel. The buffer speed regulating structure can regulate acceleration when the piston is on a tail end of a stroke and decelerates, The buffer speed regulating structure is a flexible buffer structure and further alleviate the vibration of the cylinder. Thus, the buffer speed regulating structure has higher stability and can transmitted workpieces sensitive to the vibration.

In one example, the speed regulator is a regulating screw. The cylinder body defines a regulating screw installing hole. The regulating screw is assembled from the outside. Without disassembling the cylinder, a tool like a screw driver can regulate the speed regulator outside the cylinder, and it is easy to use.

In one example, one opening in the branch gas flow channel is positioned in the middle region of the receiving hole. The receiving hole is configured with a second sealing ring that further seals the gap between the buffer rod and the receiving hole. The receiving hole is divided into two functional regions by the opening: a buffer speed regulating region and an anti-collision region.

In one example, the second sealing ring is positioned at the opening of the branch gas flow channel in the receiving hole. When entering the receiving hole and cooperating with the second sealing ring, the buffer rod obstructs gas in the main cavity body from flowing out of the branch gas flow channel.

In one example, the cross-section of the second sealing ring is trapeziform in shape. The second sealing ring has reliable sealing with the buffer rod, wear resistance, and a long service life.

In one example, the air inlet and the air outlet are arranged on a tail end of the receiving hole.

In one example, structures are arranged in each of two opposite ends of the cylinder.

In one example, buffer speed regulating structures are arranged in each of two opposite ends of the cylinder.

In one example, an axis of the buffer rod coincides with an axis of the piston. Diameter of the buffer rod is greater than diameter of the piston rod. In this way, an acting force of the buffer rod on the piston is consistent with a motion direction of the piston so that the piston has equal stress and less mechanical wear.

The present disclosure has the advantages that the cylinder of the present disclosure is configured with the anti-collision structure. The anti-collision structure comprises a buffer rod arranged on the piston. The cylinder body defines a receiving hole corresponding to the buffer rod. The receiving hole is configured with a first sealing ring that further seals a gap between the buffer rod and the receiving bole. When the piston moves in a determinded direction, the buffer rod firstly enters the receiving hole. Because the first sealing ring is arranged between the buffer rod and the receiving hole, the gas in the receiving hole does not escape and can only be compressed, thus absorbing kinetic energy of the piston and stopping the piston from moving. The buffer rod does not impact the cylinder body. Only a certain safe distance is set between the piston and the cylinder body for avoiding direct impact between the piston and the cylinder body. The anti-collision structure of the present disclosure has a flexible buffering function and does not generate hard impact. Thus, the cylinder only vibrates a little and has a high stability, and transmits the workpieces sensitive to the vibration, and increases the application range. Moreover, the mechanical damage to the cylinder is reduced, and abrasion and deformation are reduced, thus increasing service life of the cylinder.

DETAILED DESCRIPTION

Figure 1:
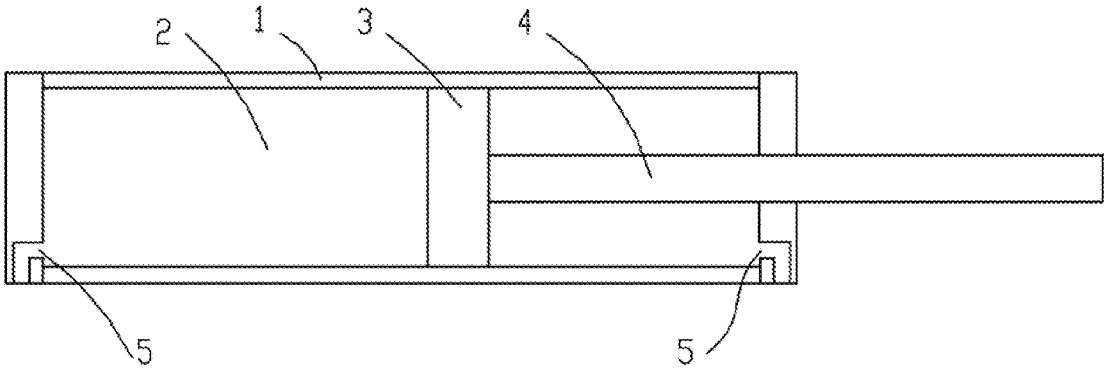
FIG. 1 is a structural diagram of a cylinder in the prior art.
Figure 2:
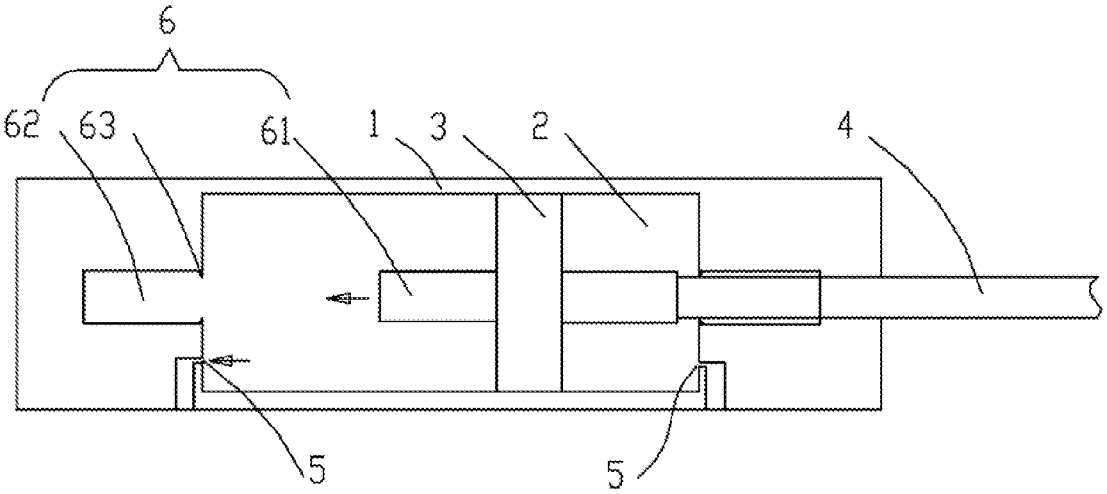
FIG. 2 is a structural diagram of a first example of a cylinder of the present disclosure.
Figure 3:
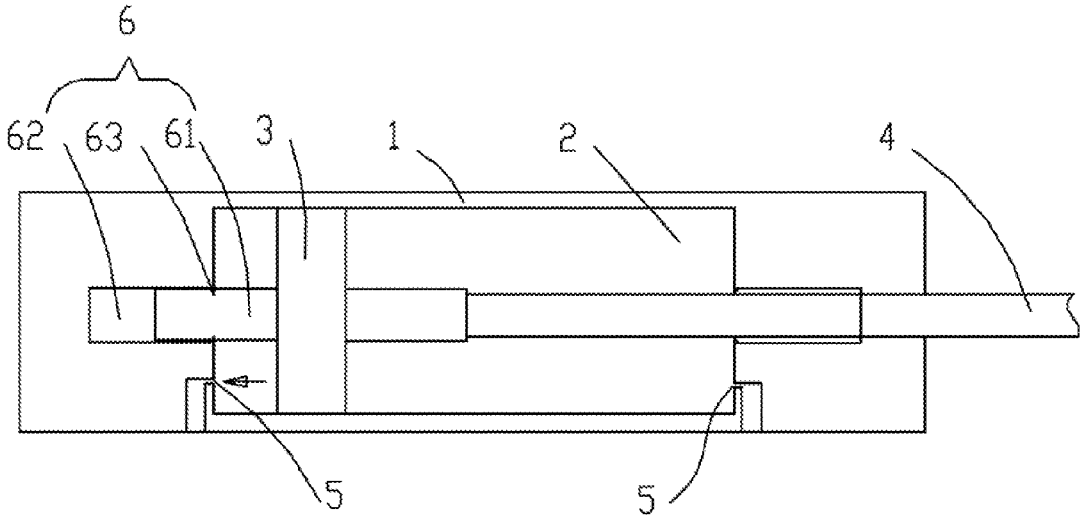
FIG. 3 is a structural diagram of a cylinder entering an anti-collision state in a first example of the present disclosure.

The present disclosure discloses a cylinder. In a first example of the cylinder of the present disclosure, as shown in FIG. 2 and FIG. 3, the cylinder comprises a cylinder body 1, a main cavity body 2, a piston 3, and a piston rod 4. The cylinder body 1 defines an air inlet and an air outlet in each of two opposite ends of the cylinder 1. The cylinder is further configured with an anti-collision structure 6. The anti-collision structure 6 comprises a buffer rod 61 arranged on the piston 3. The cylinder body 1 defines a receiving hole 62 corresponding to the buffer rod 61. The receiving hole 62 is configured with a first sealing ring 63 that further seals a gap between the buffer rod 61 and the receiving hole 62. In the example, the anti-collision structure 6 is arranged in each of two opposite ends of the cylinder. The first sealing ring 63 is arranged on an innermost side of the receiving hole 62.

In the example, an axis of the buffer rod 61 coincides with an axis of the piston 3. Diameter of the buffer rod 61 is greater than diameter of the piston rod 4. In this way, an acting force direction of the buffer rod 61 on the piston 3 is consistent with a motion direction of the piston 3 so that the piston 3 has equal stress and less mechanical wear.

The cylinder of the present disclosure is configured with the anti-collision structure 6. When the piston 3 moves in a determined direction, the buffer rod 61 firstly enters the receiving hole 62. Because the first sealing ring 63 is arranged between the buffer rod 61 and the receiving hole 62, gas in the receiving hole 62 does not escape and can only be compressed, thus absorbing kinetic energy of the piston 3 and stopping the piston 3 from moving. The buffer rod 61 does not impact the cylinder body 1. Only a certain safe distance is set between the piston 3 and the cylinder body 1 to avoid direct impact between the piston 3 and the cylinder body 1. The anti-collision structure 6 of the present disclosure has a flexible buffering function and does not generate hard impact. Thus, the cylinder only vibrates a little and has a high stability, and the cylinder transmitted workpieces sensitive to the vibration, and increases application range. Moreover, the mechanical damage to the cylinder is reduced, and abrasion and deformation are reduced, thus increasing service life of the cylinder.

Figure 4:
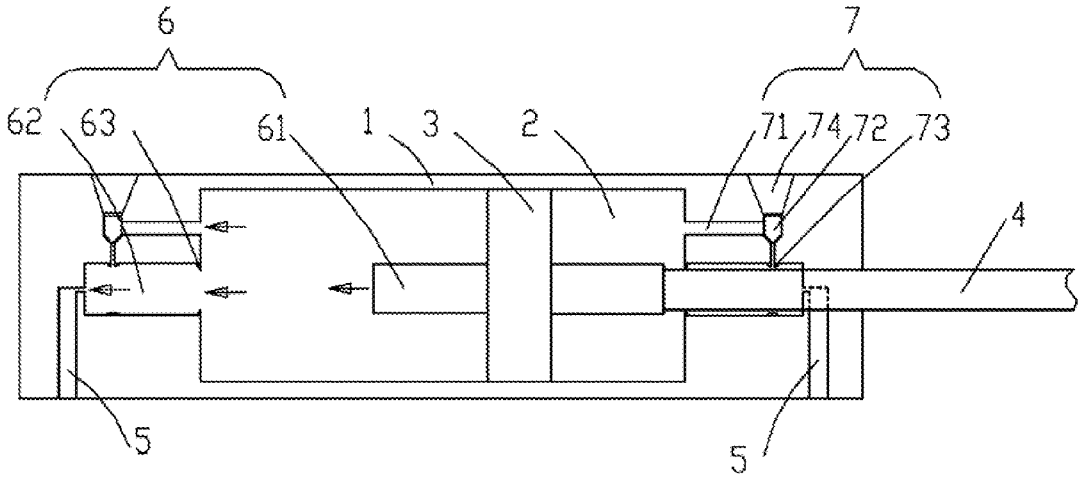
FIG. 4 is a structural diagram of a second example of a cylinder of the present disclosure.
Figure 5:
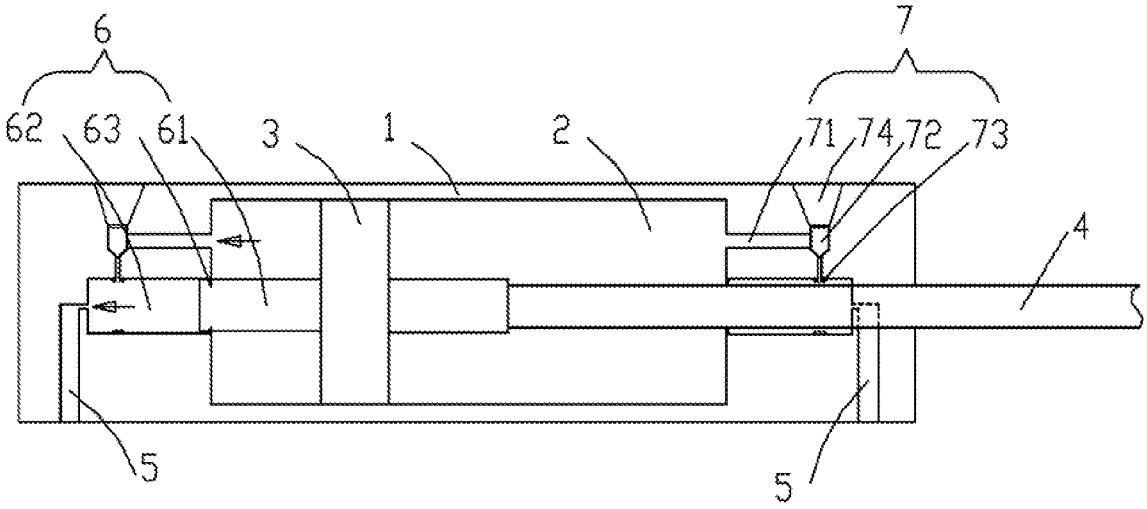
FIG. 5 is a structural diagram of a cylinder entering a buffer speed regulation state in a second example of the present disclosure.
Figure 6:
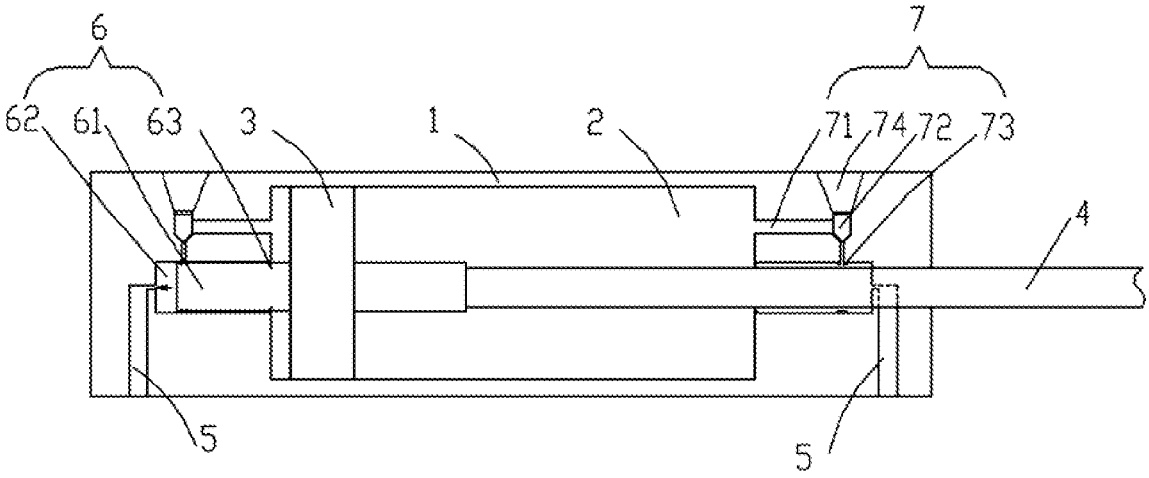
FIG. 6 is a structural diagram of a cylinder entered an anti-collision state in a second example of the present disclosure.

As a second example of the cylinder of the present disclosure, as shown in FIG. 4 to FIG. 6, difference between the second example and the first example is that the cylinder further comprises a buffer speed regulating structure 7. The buffer speed regulating structure 7 comprises a branch gas flow channel 71 that connects to the main cavity body 2 and the receiving hole 62, and a speed regulator 72 arranged on the branch gas flow channel 71. In the example, buffer speed regulating structures 7 are arranged in each of two opposite ends of the cylinder.

In the example, the air inlet and the air outlet 5 are arranged on a tail end of the receiving hole 62. One opening in the branch gas flow channel 71 is positioned in a middle region of the receiving hole 62. The receiving hole 62 is divided into two functional regions by the opening: a buffer speed regulating region and an anti-collision region. The receiving hole 62 is configured with a second sealing ring 73 that further seals the gap between the buffer rod 61 and the receiving hole 62. The second sealing ring 73 is positioned at the opening of the branch gas flow channel 71 in the receiving hole 62. When the buffer rod 61 enters the receiving hole 62 and cooperates with the second sealing ring 73, the buffer rod 61 obstructs gas in the main cavity body 2 from flowing out of the branch gas flow channel 71.

The working principle of the cylinder is described by that the piston moves in the left direction as an example. As shown in FIG. 4, the piston 3 of the cylinder moves in the left direction. The gas positioned on the left side of the piston in the main cavity body 2 enters the receiving hole 62 and escapes from the air inlet and the air outlet 5. At this moment, the piston 3 can quickly move.

As shown in FIG. 5, the cylinder enters a buffer speed regulation state. The buffer rod 61 enters the buffer speed regulation region of the receiving hole 62. Because the first sealing ring 63 acts as a sealant, gas positioned on the left side of the piston in the main cavity body 2 can only enter the holding 62 through the branch gas flow channel 71 and escape from the air inlet and the air outlet 5. At this moment, escape speed of the gas is controlled by the speed regulator 72. Thus, the motion speed of the piston 3 is regulated. The piston can be decelerated quickly and slowly.

As shown in FIG. 6, the cylinder enters the anti-collision state. The buffer rod 61 enters the and-collision region of the receiving hole 62. Because of the second sealing ring 73, the gas positioned on the left side of the piston in the main cavity body 2 may not escape, and can only be compressed, thus absorbing the kinetic energy of the piston and stopping the piston 3 moving. The buffer rod 61 does not impact the cylinder body 1. The piston 3 does not directly impact the cylinder body 1.

The buffer speed regulating structure 7 of the present disclosure can regulate acceleration of piston when the piston 3 is on the tail end of a stroke and decelerates. The buffer speed regulating structure 7 is a flexible buffer structure and further alleviates the vibration of the cylinder. Thus, the buffer speed regulating structure 7 has a higher stability and transmits the workpieces sensitive to the vibration.

In the example, the speed regulator 72 is a regulating screw. The cylinder body 1 defines a regulating screw installing hole 74. The regulating screw is assembled from outside of the cylinder without disassembling the cylinder. A tool, like a screw driver, can regulate the speed regulator outside of the cylinder and, and it is easy to use.

In the example, a cross-section of the second sealing ring 73 is trapeziform in shape. The second sealing ring has a reliable sealing with the buffer rod 61, wear resistance, and a long service life.

The present disclosure is described in detail in accordance with the above contents with the specific preferred examples.

However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

The invention claimed is:

1. A cylinder, comprising:

a cylinder body defining an air inlet and an air outlet in each of two opposite ends of the cylinder body a main cavity body;

a piston;

a piston rod; and an anti-collision structure;

wherein the anti-collision structure comprises a buffer rod arranged on the piston;

wherein the cylinder body defines a receiving hole corresponding to the buffer rod; the receiving hole is configured with a first sealing ring that seals a gap between the buffer rod and the receiving hole;

wherein the cylinder further comprises a buffer speed regulating structure; the buffer speed regulating structure comprises a branch gas flow channel that connects to the main cavity body and the receiving hole, and a speed regulator arranged on the branch gas flow channel, wherein the speed regulator is a regulating screw;

wherein the cylinder body further defines a regulating screw installing hole; one opening in the branch gas flow channel is positioned in a middle region of the receiving hole; the receiving hole is configured with a second sealing ring that further seals the gap between the buffer rod and the receiving hole; the second sealing ring is positioned at the opening of the branch gas flow channel in the receiving hole; when the buffer rod enters the receiving hole and cooperates with the second sealing ring, the buffer rod obstructs gas in the main cavity body from flowing out of the branch gas flow channel; a cross-section of the second sealing ring is trapeziform in shape;

wherein the air inlet and the air outlet are arranged on a tail end of the receiving hole; an axis of the buffer rod coincides with an axis of the piston; diameter of the buffer rod is greater than diameter of the piston rod.

2. A cylinder, comprising:

a cylinder body defining an air inlet and an air outlet in each of two opposite ends of the cylinder body;

a main cavity body;

a piston;

a piston rod; and an anti-collision structure;

wherein the anti-collision structure comprises a buffer rod arranged on the piston; the cylinder body defines a receiving hole corresponding to the bugger rod, the receiving hole is configured with a first sealing ring that further seals a gap between the buffer rod and the receiving hole, wherein the cylinder further comprises a buffer speed regulating structure: the buffer speed regulating structure comprises a branch gas flow channel that connects to the main cavity body and the receiving hole, and a speed regulator arranged on the branch gas flow channel, wherein one opening in the branch gas flow channel is positioned in a middle region of the receiving hole; the receiving hole is configured with a second sealing ring that further seals the gap between the buffer rod and the receiving hole.

3. The cylinder of claim 2, wherein the speed regulator is a regulating screw; the cylinder body further defines a regulating screw installing hole.

4. The cylinder of claim 2, wherein the second sealing ring is positioned at the opening of the branch gas flow channel in the receiving hole; when the buffer rod enters the receiving hole and cooperates with the second sealing ring, the buffer rod obstructs gas in the main cavity body from flowing out of the branch gas flow channel.

5. The cylinder of claim 2, wherein a cross-section of the second sealing ring is trapeziform in shape.

6. The cylinder of claim 2, wherein the air inlet and the air outlet is arranged on a tail end of the receiving hole.

7. The cylinder of claim 2, wherein anti-collision structures are arranged in each of two opposite ends of the cylinder.

8. The cylinder of claim 2, wherein buffer speed regulating structures are arranged in each of two opposite ends of the cylinder.

9. The cylinder of claim 2, wherein an axis of the buffer rod coincides with an axis of the piston; diameter of the buffer rod is greater than diameter of the piston rod.

* * * * *